United States Patent [19]

Dubreuil

[11] 4,090,387

[45] May 23, 1978

[54] BENDING-TOOL AND A DEVICE FITTED OUT WITH SUCH A TOOL

[75] Inventor: Serge Dubreuil, Chatou, France

[73] Assignee: S.A. Ermeto, La Verriere le Mesnil Saint Denis, France

[21] Appl. No.: 745,193

[22] Filed: Nov. 26, 1976

[30] Foreign Application Priority Data

Nov. 28, 1975 France ..... 75 36635

[51] Int. Cl.[2] ..... B21D 7/024

[52] U.S. Cl. ..... 72/217

[58] Field of Search ..... 72/215, 216, 217, 219, 72/153

[56] References Cited

U.S. PATENT DOCUMENTS

| | | | |
|---|---|---|---|
| 921,677 | 5/1909 | Dement | 72/215 |
| 1,967,162 | 7/1934 | Taylor | 72/219 |
| 3,956,916 | 5/1976 | Herkner et al. | 72/217 |

*Primary Examiner*—Milton S. Mehr

*Attorney, Agent, or Firm*—Sherman Levy

[57] ABSTRACT

A bending-tool carrying a cylindrical bending roller whose diameter is selected depending on the bending radius, this tool carrying a fixing means to secure the tube to be bent in relation to the bending roller, as well as a pressure element movable in relation to said bending roller so as to apply the tube to be bent against the cylindrical bending roller and a tool wherein the pressure element is guided according to an involute curve, in relation to the bending roller.

3 Claims, 8 Drawing Figures

BENDING-TOOL AND A DEVICE FITTED OUT WITH SUCH A TOOL

The invention relates to a bending-tool carrying a cylindrical bending roller whose diameter is selected depending on the bending radius, this tool carrying a fixing means to secure the tube to be bent in relation to the bending roller, as well as a pressure element to apply the tube to be bent against said cylindrical bending roller.

Bending tools are already known (FIG. 1); they consist of a plate B on which a cylinder A whose circumference carries a groove C is secured. The diameter of the section of the groove C is the same as that of the tube to be bent. A handle is secured to the cylinder A which permits the tool to be held. A second handle movable in relation to the first one carries a small wheel E which also carries a groove the section of which has also a diameter equal to that of the tube to be bent. So as to bend a tube, the latter is first chocked up between the small wheel E and the cylinder A, afterwards the handle carrying the small wheel E is rocked in the direction of the arrow shown in FIG. 1, by making the small wheel E roll along the tube to be bent so as to apply it around the cylinder A. Thus, the tube is progressively bent by traveling according to the positions I, II, III shown by way of example.

Also, it is possible to use bending formers which are secured to a support; said formers can be fitted out with several hand tools, such as those described hereabove.

Bending which is performed by hand, takes a long time and is not precise.

Furthermore, when bending is performed, the small wheel rolls along the tube to be bent and the pressure thus exerted thereon causes such tube to be flattened. Such a flattening of the tube not only weakens it, but also elongates it. Under these circumstances, it is quite impossible to simultaneously perform several bendings on one and the same tube.

Also, machines to perform bending by hand are known, which carry several bending rollers making it possible to bend several tubes in succession. It is not possible to automatically and simultaneously achieve such bendings since the successive elongations of the tube during the various bending operations must be taken into account.

Also, bending tools of the same type as those described above are already known, which are mechanically operated, for example by a hydraulic driving means operated according to a program. Such tools show the drawback to require a very long time to perform bending. Furthermore, working out and programing are operations which necessitate a very long time to be achieved and are determined for each type of tube to be bent.

Although in many cases intermediate bendings, between end bendings of a tube show only a relative importance, said intermediate bendings being only aimed to overcome obstacles, etc, it is nevertheless desirable from the technical development point of view to achieve defined intermediate bendings, very precise, so as to reduce constraints and heat-expansions and prevent the resonance of the tube.

As it is the case when bending is performed by hand, the small wheels of automatic bending-machines tend to either elongate or flatten the tube. It results therefrom that the succession of bending operations is quite special and, thereby, it is necessary to achieve them in turn. This considerably increases the machining time.

In some cases, for example when ducts of internal combustion engines are involved, the bent ducts are joined together with rings before setting the various ducts onto engines. When in such a case bending is not precise, this has repercussions on the other bendings or bent tubes.

The present invention is aimed to remedy the drawbacks shown by already known bending-machines, and to particularly create a bending-tool which does not generate elongation.

Also, the invention is aimed to provide a bending-machine several bendings to be made simultaneously or sequentially bendings. .

To this end, the invention relates to a bending-tool wherein the pressure element is guided according to an involute curve in relation to the cylindrical bending roller.

In view that when bending is performed the pressure element describes an involute curve, flattening of the tube and, thereby, elongation thereof are avoided, which is not the case when already known bendings are performed. This makes is possible to achieve simultaneously or in any order whatever, several bending operations. Furthermore, such a fitting enables the precision of the bending to be increased and prevents the bent tubes from being weakened.

According to an advantageous feature of the invention, the pressure element carries a sliding device co-operating with an axis of the bending roller, and carries a guiding element which co-operates with an involute shaped, guide path said guide-path being integral with the bending roller.

The pressure element may be located in any desired positioned, thus making it possoble to achieve complex bendings. However, bending is theoretically limited to a maximum angle of 360°. Such a limit depends on the length of the guide-path and on the fact that it is not easy to achieve a guide-path in the form of a slide, for example, which would describe an arc of circle over 360°.

According to a further advantageous characteristic of the invention, the pressure element carries a rack which co-operates with suitable teeth provided on the peripheral of the bending roller.

Perhaps, such a bending-tool is more complicated than that referred to hereablve, but it makes it possible to perform bendings at angles over 360° and even bending on several whorls, to achieve propellers.

According to another characteristic of the invention, the pressure element carries a holding element to hold a portion of the tube to be bent.

According to an advantageous characteristic of the invention, the bending roller carries a cut portion to receive protruding elements previously secured on the tube before bending it.

According to a further advantageous feature of the invention, the bending-tool carries a driving means, such as a jack which is provided between the bending roller and the pressure element so as to generate a relative motion between such elements. The piston of the jack can be fitted on the pressure element.

Also, the invention relates to a bending-machine fitted up with several bending-tools.

Also, the invention relates to a bending-machine fitted up with several bending-tools.

Under the same conditions, the invention applies to small bending-machines operated by hand, or to machines automatically driven making it possible to perform simultaneously or in any order whatever bending operations, and this within two or three dimensions in space.

The invention will be described with more details by means of the Drawings attached thereto, wherein.

Figure 1:
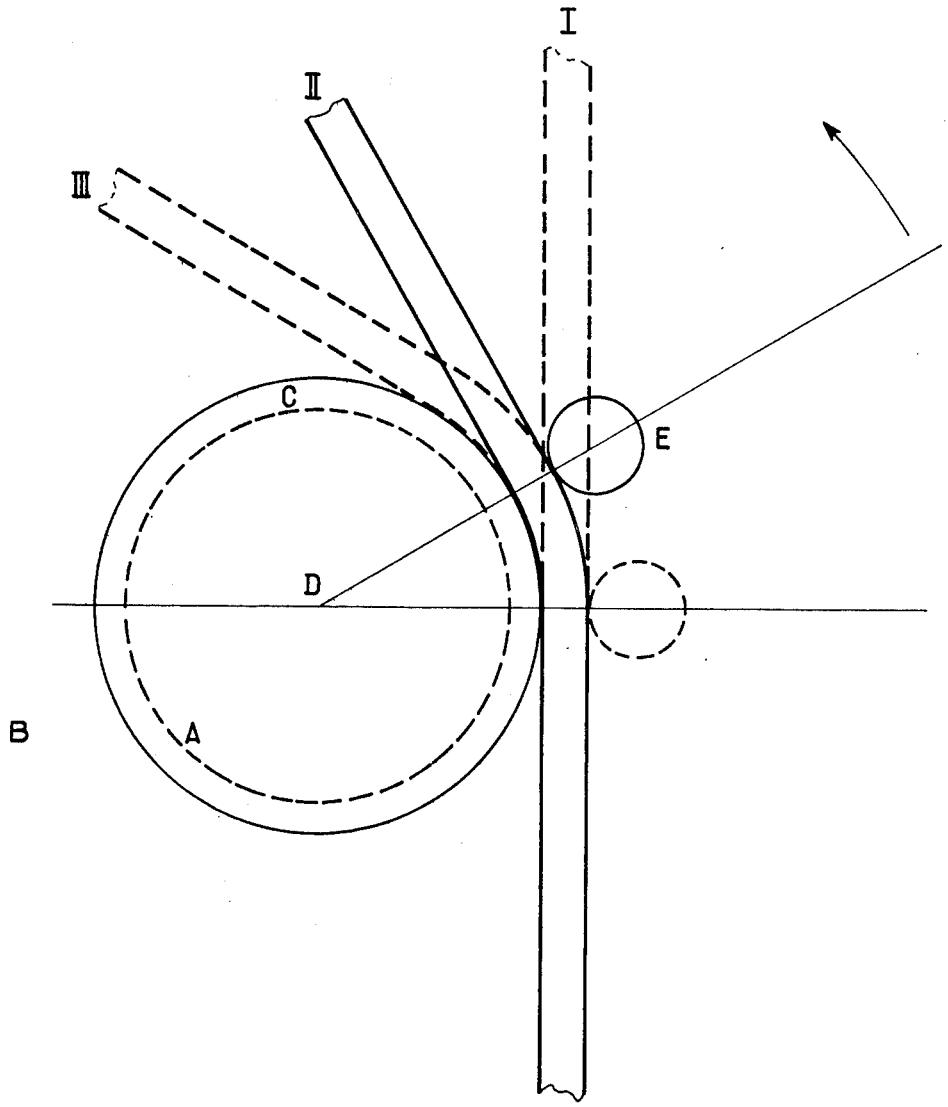
Figure : 1 PRIOR ART
FIG. 1 is a diagrammatical view from above of a known bending-tool.
Figure 2:
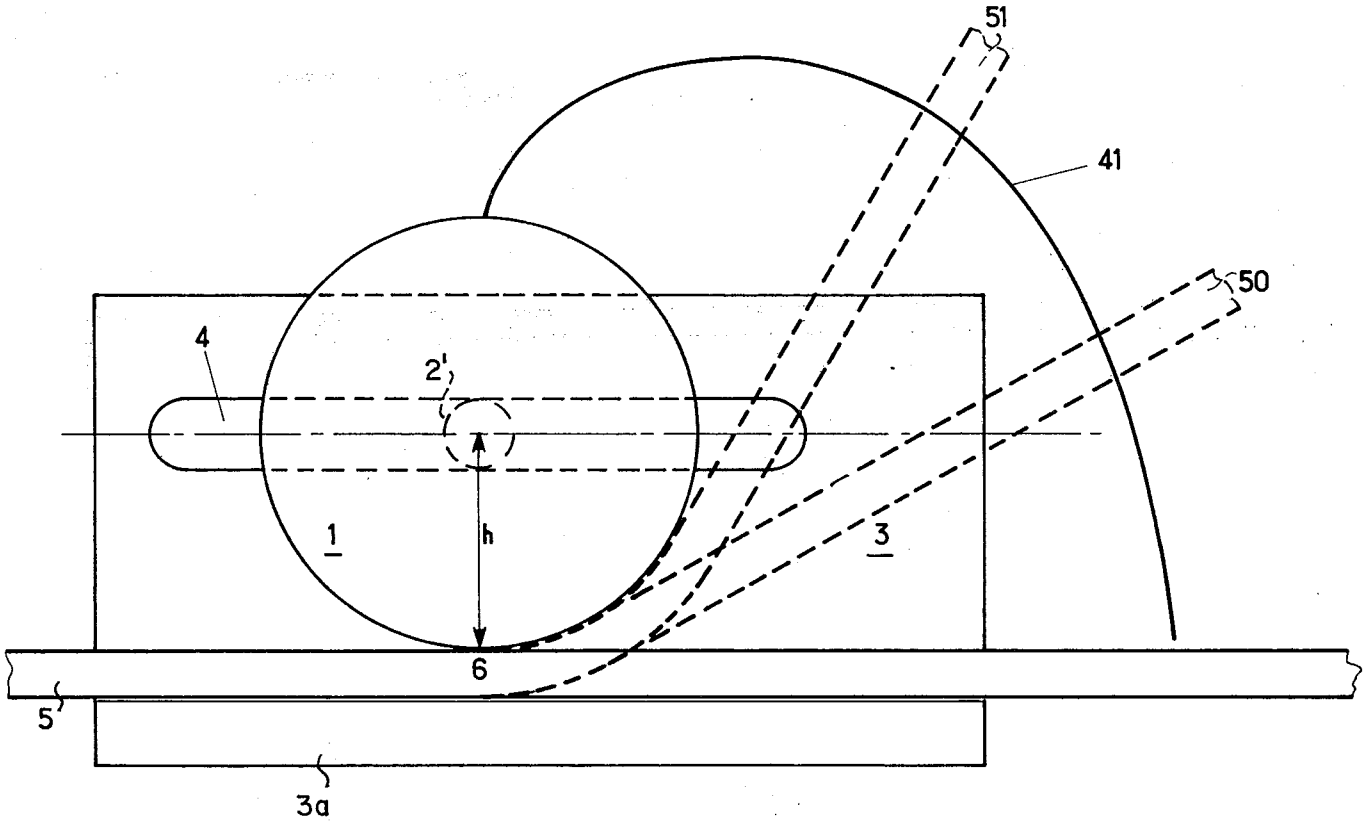
FIG. 2 is a part diagrammatical view showing details, from above, of a first mode of embodiment of a bending-tool such as provided by the invention, and diagrammatically showing the motion of a bending operation in process.

As shown in FIG. 2, the bending-tool carries a bending roller 1 whose diameter is selected depending on the bending to be performed. Said bending roller 1 is generally cylindrical and is positioned above a supporting element 3 by a fixed shaft 2 carried by a base. This supporting element 3 is movable in relation to the cylindrical bending roller 1 by means of a slat 4. The supporting element 3 can be moved along a trajectory which corresponds to an involute curve 41; the trajectory thereof is limited by the slat 4 and a guide-element (not shown) co-operating with a corresponding guide-path integral with the base. FIG. 2 shows in full line the former position of a tube 5 to be bent. During bending, the tube 5 is successively positioned such as shown in dash line and referenced 50, 51. In FIG. 2, the tube 5 is shown as being positioned; said tube 5 is put into contact with the bending roller 1 at point 6. On the tube 5, said point 6 shows the portion thereof to be first bent. When any bending of the tube is performed, the distance of the central axis 2 of the bending roller 1 from the point of contact 6 of the tube 5 is always equal to *h*, that is to say, to the radius of the bending roller 1.

So as to ensure bending of the tube 5 around the bending roller 1, the supporting element 3 carries, for example, a pressure member 3*a*. The whole length of said pressure member applies against the tube 5 to be bent when the latter is in its former position.

When bending is performed, only the right hand portion (as shown in FIG. 2) of the pressure member 3*a*, in relation to the first bending point 6, applies against the tube 5 to be bent. Thereby, there is no relative motion between the element 3 (or its pressure member 3*a*) and the portion of the tube 5 in contact with the edge 3*a* or more generally with the element 3, contrary to the Prior Art whereby the roller E rolls along the tube when bending is being performed, and tends to elongate it.

Figure 3:
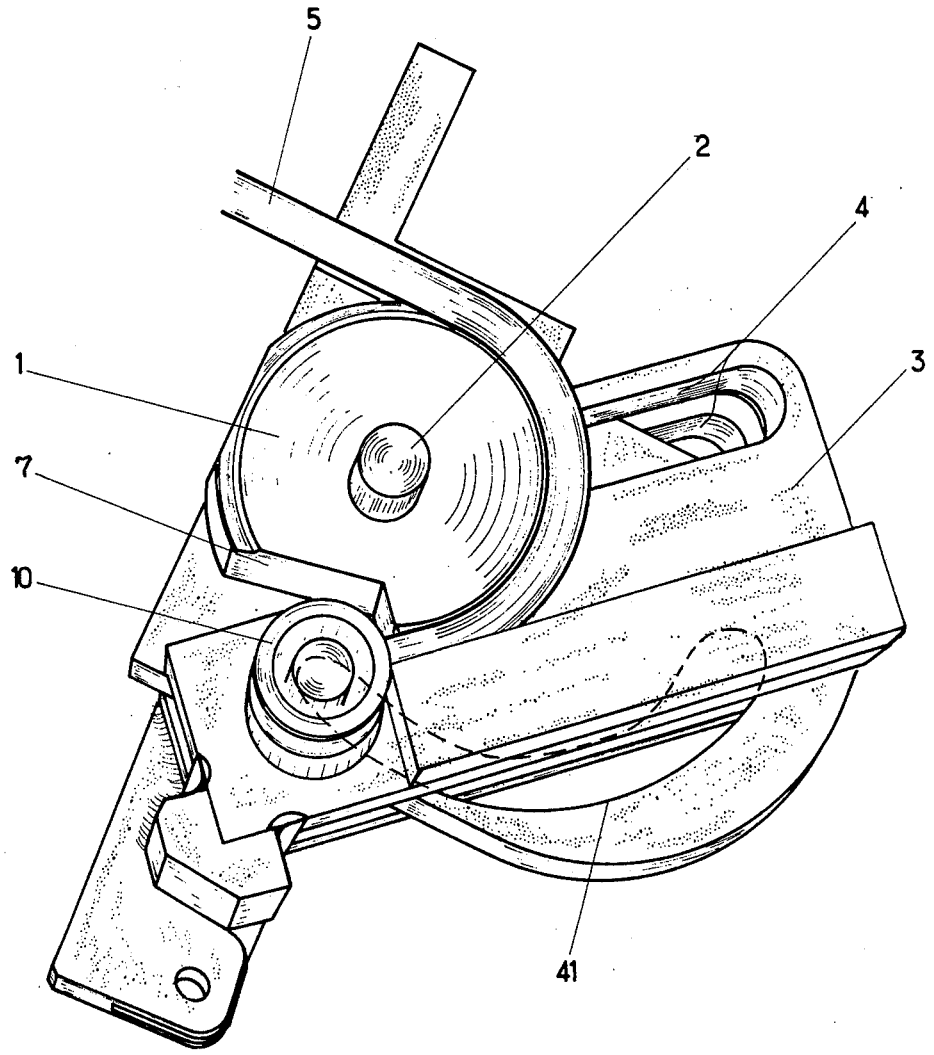
FIG. 3 is a front view in perspective of a first mode of embodiment of the bending-tool provided by the invention.

As shown in FIG. 3, the bending-tool carries as that shown in FIG. 2, a cylindrical bending roller 1 fixed to a shaft 2 and a supporting element 3 having a pressure member 3*a* with such element 3 being movable in relation to the cylindrical bending roller 1. The element 3 carries a slot 4. The element 3 can travel along a traveling-path corresponding to an involute curve and by means of a guide-element located within an involute shaped guide path 41 formed in the base on which the bending roller 1 is mounted. As per FIG. 3, the tube 5 to be bent carries a front element 10, also called banjo.

As it can be seen from FIG. 3, the bending roller 1 carries a cut out portion 7 in which the element 10.

Figure 4:
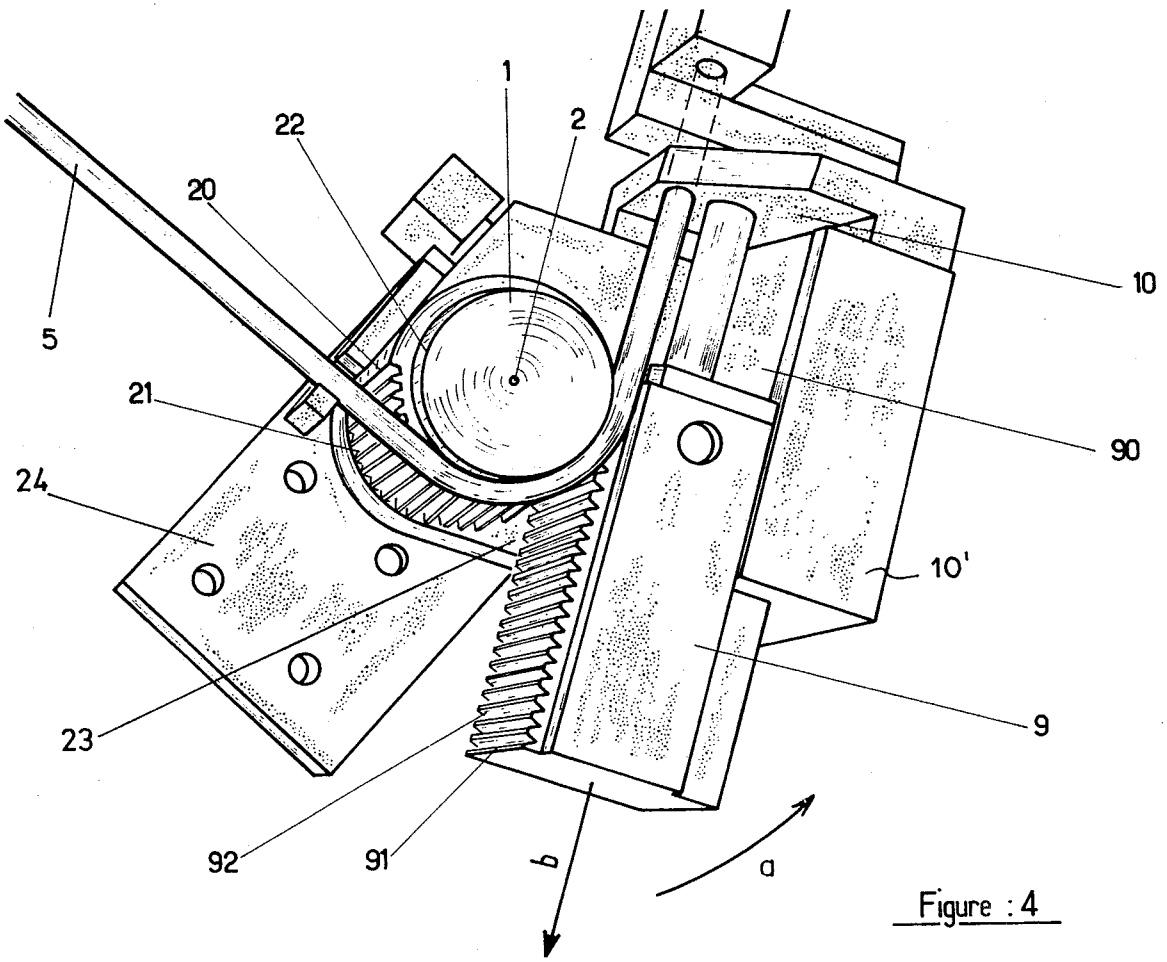
FIG. 4 is a view in perspective of a second embodiment of the bending-tool provided by the invention.

As shown in FIG. 4, the bending-tool includes a cylindrical bending roller 1 mounted on a fixed shaft 2 which is mounted on a fixed plate 24. The motion of a point when bending is performed follows an involute curve on the tube 5; for operating driving, the device comprises a rack and a cog-pinion. For that reason, the peripheral surface of the cylindrical bending roller 1 carries straight teeth 21. Furthermore, a pressure element 9 in the form of a carriage is also provided, which is longitudinally guided by a guide-surface 90 carried by a slide or support element 10'.

As it can be seen in FIG. 4, the lateral surface 91 of the pressure element 9 which faces the bending roller 1 carries teeth 92 corresponding to the teeth 21 of the bending roller 1. Besides, the bending roller 1 carries a groove 22 whose size corresponds to that of the diamater of the tube 5 to be bent. When motion is starting, the element 9 in the form of a carriage directly applies against the surface 10'. The pressure element 9 and the support element 10' are carried by a plate 23 which is pivotally mounted on the fixed shaft 2. Then, the element 9 is moved either by hand or automatically, in the direction of the arrow *b*. Thanks to the pivoting plate 23, which pivots around the shaft 2, the guide-surface 90 and the pressure element 9 pivot together in the direction of the arrow *a* around the bending roller 1. The tube 5 to be bent is chocked up into the groove 22 between the bending roller 1 and the element 9. At the same time, the right hand end of the tube to be bent describes an involute in relation to a circle formed by the cylindrical bending roller 1. The bending-tool carrying the assembly rack-cog-pinion is more cumbrous than the tool formerly described which carries a guide-slot. However, this last embodiment shows the advantage of making it possible to bend tubes at a bending angle over 360°. Bendings with several whrols can even be envisaged, so as to produce a serpentine tube. In addition, it is also possible to achieve with said tool a small-sized bending device likely to be operated by hand, or again a greater mechanical bending device carrying several bending stations whose bending-tools are, for example, operated by hydraulic driving means. Such a device can be used to bend tubes at one or more levels.

The description made hereafter from FIGS. 5 to 8 relates to a bending device of the same type as that described above, fitted with several bending-tools. The bending device, or bending-machine, being in bulk references 70, is fitted with five bending-tools 11, 12, 13, 14, 15. The bending-tools 11, 12, 13, 14 carry a pressure element having a rack and a cog-pinion. The bending-tools 11, 12, 13, 14 carry in addition an hydraulic driving means located between the cylindrical bending roller 110, 120, 130 and 140 and the element applying the pressure 112, 113, 114, 115, so as to generate a relative motion between the bending roller and the pressure element.

In the bending-rool 15 carrying a rack and a cog-pinion, an auxiliary roller 150' is provided at the portion located behind the bending roller 150; said auxiliary roller carries teeth 150''. The teeth 150'' co-operate with a shoulder 159 also carrying teeth 159' corresponding to teeth 150'' of the auxiliary roller 150'; teeth 159' always mesh with teeth 150''. The bending rollers 110, 120, 130 and 140 of each bending-tool 11, 12, 13, 14, 15 constitute movable parts within each cylinder 111, 121, 131 and 141; the movable parts 11, 12, 13, 14, 15 can stand set back in relation to the cylinder 111, 121, 131, 141 and occupy an outlet position; when standing set back, or in a within position, the movable elements 11, 12, 13, 14, 15 are substantially on a level with the upper edge of the cylinder, while when at the outlet position the movable elements 11, 12, 13, 14, 15 form with the corresponding edge of each cylinder 11, 121, 131, 141 and 151, a groove or bending support 113, 123, 133, 143 and 153.

A bending operation of a tube 5 will be described hereafter by using successive stages of the bending operation. It is nevertheless to be noticed that, as there is no sliding motion between the bending element and the tube to be bent, all the bending operations whatever their direction, should bending be performed in one and the same plane or on different planes, are operations likely to be performed independently from each other.

Figure 5:
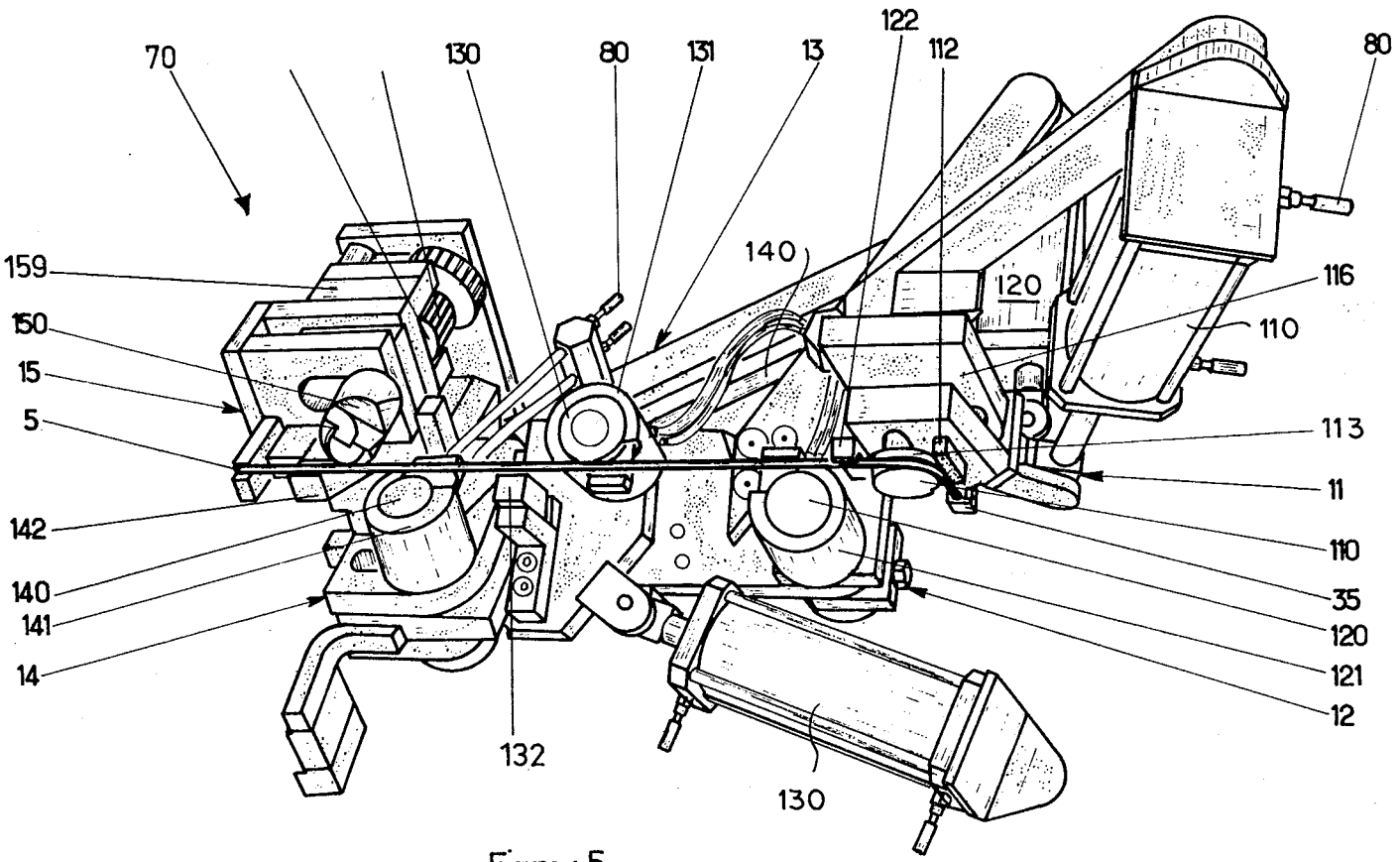
FIG. 5 is a perspective of an apparatus for making a plurality of bends in a tube.

Introducing a tube:

As shown in FIG. 5, the tube 5 to be bent is first positioned in the various bending-tools 11, 12, 13, 14, 15; the tube rests against the non-retractable applying elements; the end of the tube rests against an abutment 35.

The bending rollers 120, 130, 140, 150 of the bending-tools 12, 13, 14, 15 are at a resting position, that is to say, they are standing at a set back position; at such a position, the rollers 120, 130, 140, 150 are not in a level with the edge of the corresponding cylinder 121, 131, 141, 151. The outlet and set back motions of the bending rollers 110, 120, 130, 140 and 150 are, for example, ensured by double-effect pistons which receive a motor fluid through the ducts connected with the delivery tubes 80.

When starting the bending operation, the bending roller 110 is brought to an outlet position in relation to the cylinder 111. Then, the pressure element 112 starts moving along the guide-path 116, so as to bend the end of the tube 5. The motion of the pressure elements 112, 122, 132 and 142 along their respective guide-path 116, 126, 136 and 146, or again the motion of the shoulder 159, are operated by, for example, double-effect jacks.

The feeding ducts of the driving jacks (piston-cylinder unit) are not shown in FIGS. 5 to 8.

In FIG. 5, the right hand portion of the tube 5 is shown already bent so as to simplify the Figure.

Figure 6:
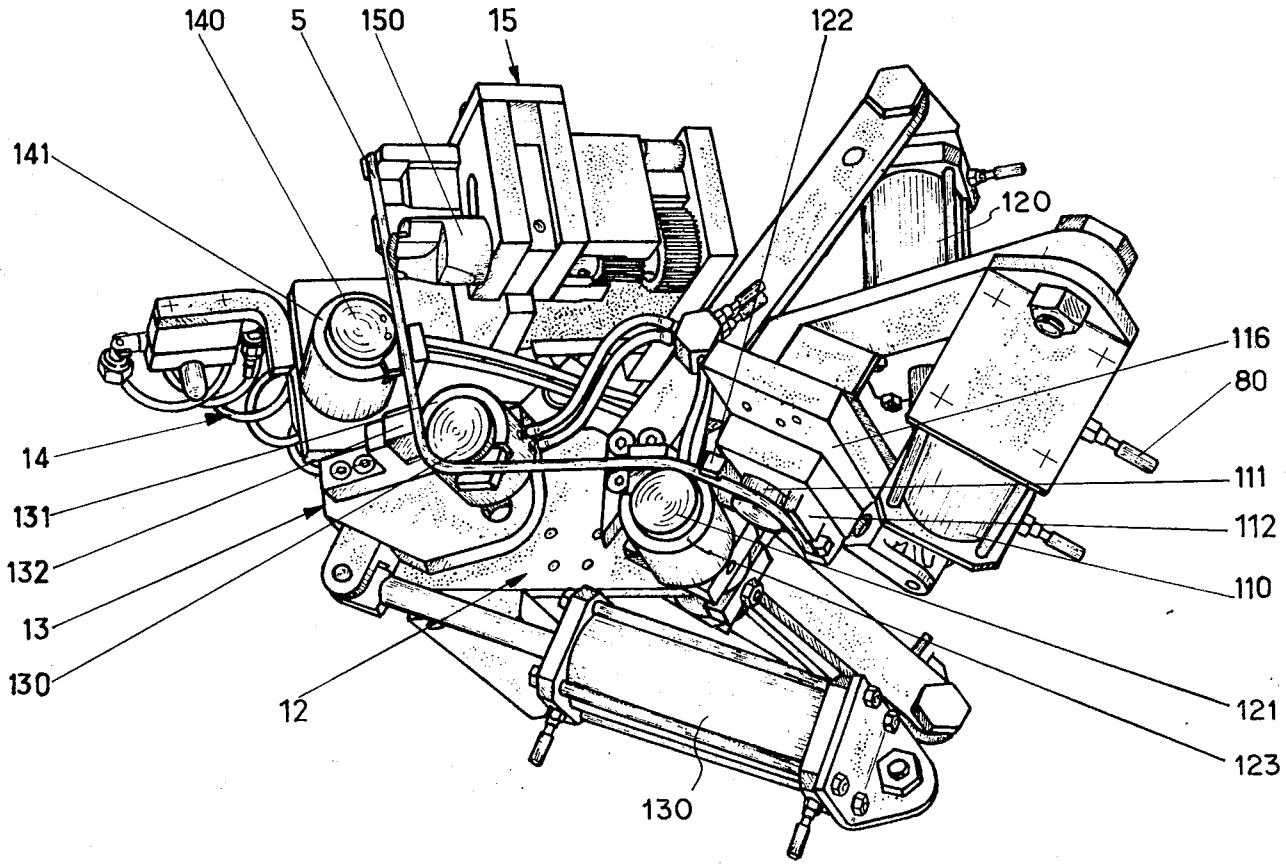
FIG. 6 is a perspective similar to FIG. 5 illustrating the tube partially bent.

Second stage of the motion:

As it results from FIG. 6, the bending-tools 12, 13, 14 are put at work. The bending rollers 120, 130, and 140 are at a working position, which means that they are at an outlet position in relation to their respective cylinder 121, 131 and 141; the rollers form with the edge of their envelope a bending supporting point 123, 133 and 143 against which the tube 5 to be bent rests. Vis-a-vis the stage shown in FIG. 5, the bending-tool 12 has begun to slightly bend the tube 5, while the bending-tool 13 has achieved bending of the tube by about 90° and that the pressure element 32 has already traveled along a great portion of its involute curve trajectory.

Figure 7:
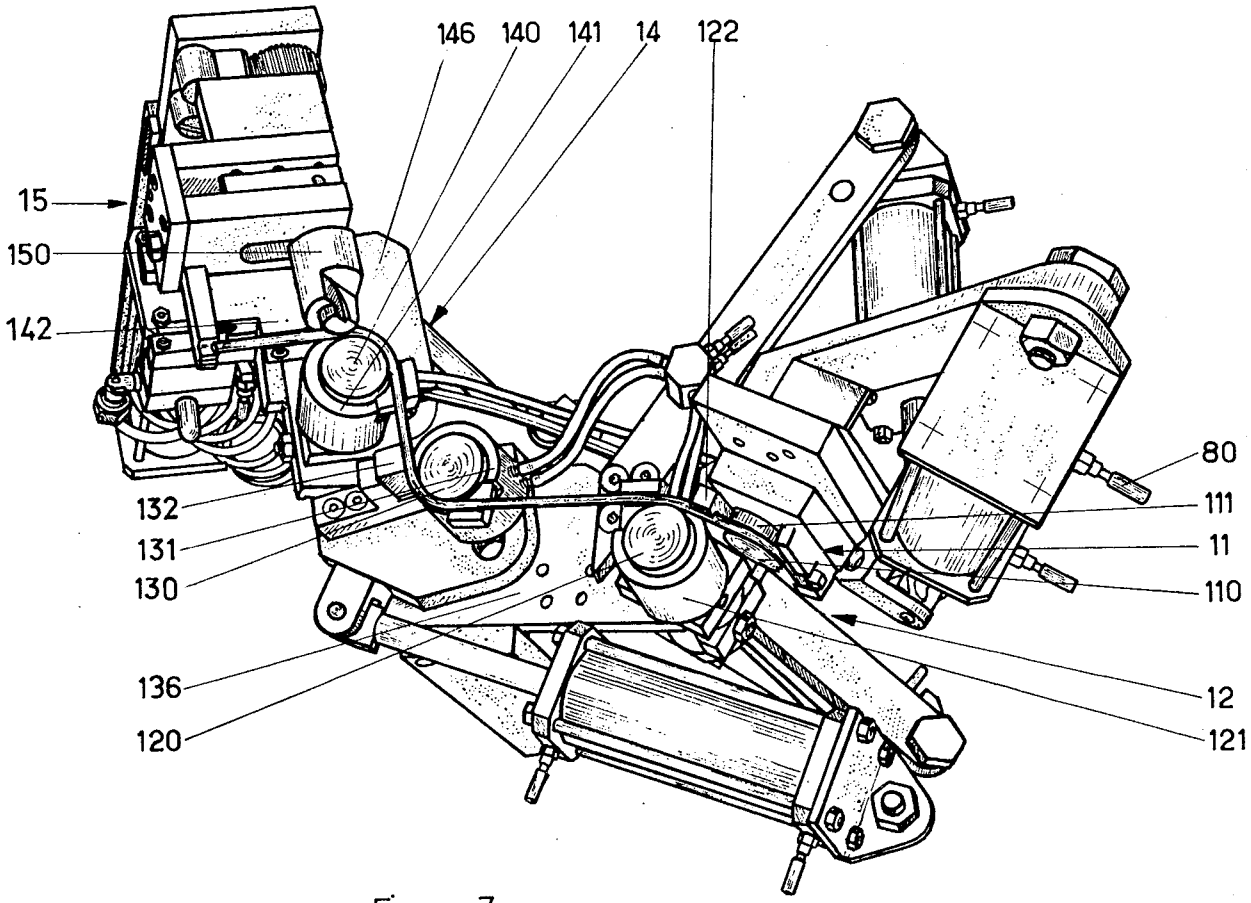
FIG. 7 is a perspective similar to FIG. 6 and illustrating additional bends in the tube.

Third stage of the motion:

As shown in FIG. 7, the bending-tool 14 has started its bending motion. The tube 5 is shown as being bent by 90° on a level with the bending-tool 14. The pressure element 142 of the bending-tool 14 has already traveled along its involute trajectory which is determined by the guide-path 146. The bending-tool 115 is on the verge to be put at work.

Figure 8:
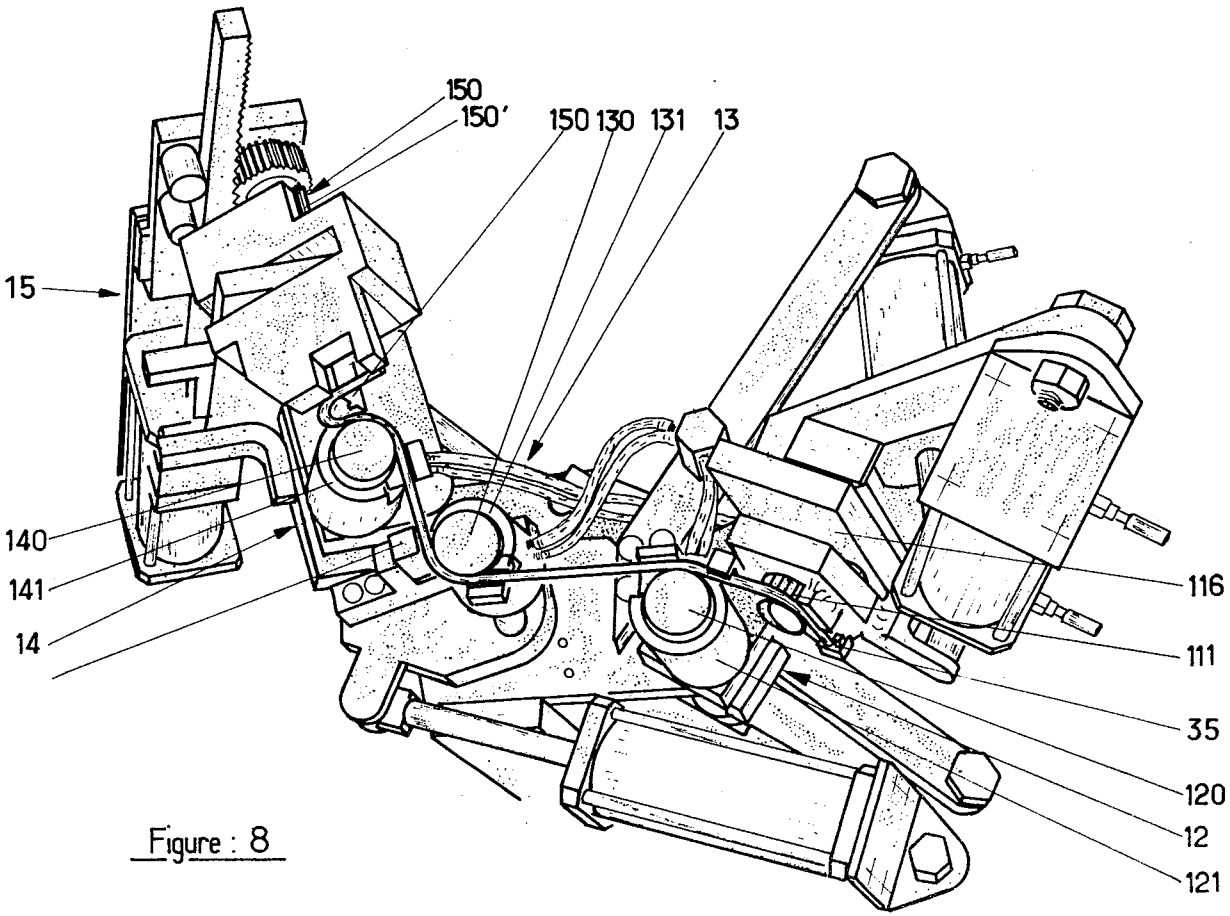
FIG. 8 is a perspective similar to FIG. 7 and illustrating the final bending of the tube.

Forth stage of the motion:

As shown in FIG. 8, the pressure element 159, which does no longer appear in that Figure, has traveled along the auxiliary roller 150', driven by the teeth 150'' and thus has made an involute motion which operates the bending-tool 15. In FIG. 8, the left hand end of the tube 5 is shown as being greatly bent.

Fifth Stage of the motion: (Not shown)

As soon as the tube 5 is totally bent, the bending roller is brought into a set back position within the respective cylinders so as to make extraction of the tube 5 possible.

As stated hereabove, so as to facilitate the description, a stage by stage description has been made by analysing various stages of motion. It is clear that, since there is no sliding motion between the tube and the bending elements, all the operations can be simultaneously performed.

Of course, the invention is not limited to the modes of embodiment described and depicted hereabove, from which other modes and forms of embodiments can be provided without thereby departing from the scope of the invention.

I claim:

1. A tube bending apparatus comprising a base, a fixed shaft mounted on said base, a generally cylindrical bending member non-rotatably attached to said shaft, a supporting element movably mounted on said shaft, said supporting element including an elongated pressure applying member for engaging a substantial length of a tube to be bent and holding the tube in engagement with said bending member, means for moving said pressure applying member, and means for causing said pressure applying member to follow an involute curved path so that said pressure applying member moves around said bending member and bends the tube along a shifting point of contact without causing relative movement between the tube and said pressure applying member.

2. The structure of claim 1 in which said means for causing said pressure applying member to follow an involute curved path includes an involute curved slot carried by said base, and a follower mounted on said supporting element.

3. The structure of claim 1 in which said means for causing said pressure applying member to follow an involute curved path includes gear means fixed to said bending member, and rack means movably mounted on said supporting element.

* * * * *